US012454741B2

(12) United States Patent
Suzuki et al.

(10) Patent No.: US 12,454,741 B2
(45) Date of Patent: Oct. 28, 2025

(54) ALUMINUM ALLOY EXTRUDED MULTI-HOLE TUBE FOR HEAT EXCHANGER AND METHOD FOR MANUFACTURING THE SAME

(71) Applicant: UACJ Corporation, Tokyo (JP)

(72) Inventors: Taichi Suzuki, Tokyo (JP); Ryo Tomori, Tokyo (JP); Hidetoshi Kumagai, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 431 days.

(21) Appl. No.: 18/009,413

(22) PCT Filed: Jun. 2, 2021

(86) PCT No.: PCT/JP2021/020946
§ 371 (c)(1),
(2) Date: Dec. 9, 2022

(87) PCT Pub. No.: WO2021/251227
PCT Pub. Date: Dec. 16, 2021

(65) Prior Publication Data

US 2023/0220521 A1 Jul. 13, 2023

(30) Foreign Application Priority Data

Jun. 11, 2020 (JP) ..... 2020-101474

(51) Int. Cl.
*C22C 21/00* (2006.01)
*C22F 1/04* (2006.01)

(52) U.S. Cl.
CPC ..... *C22C 21/00* (2013.01); *C22F 1/04* (2013.01)

(58) Field of Classification Search
CPC ..... C22C 21/00; C22F 1/04
See application file for complete search history.

(56) References Cited

U.S. PATENT DOCUMENTS

| | | | | |
|---|---|---|---|---|
| 9,857,128 | B2 | 1/2018 | Furumura et al. | |
| 2004/0154709 | A1 | 8/2004 | Taguchi et al. | |
| 2013/0118013 | A1* | 5/2013 | Yamashita | C23C 30/00 29/890.046 |

FOREIGN PATENT DOCUMENTS

| | | | |
|---|---|---|---|
| JP | H11-335764 | A | 12/1999 |
| JP | 2000008130 | A * | 1/2000 |

(Continued)

OTHER PUBLICATIONS

JP-2000008130-A english (Year: 2000).*

(Continued)

*Primary Examiner* — Ricardo D Morales
(74) *Attorney, Agent, or Firm* — WHDA, LLP

(57) ABSTRACT

An aluminum alloy extruded multi-hole tube for a heat exchanger is formed of an aluminum alloy comprising Mn of 0.60 to 1.80 mass % and Si of 0.20 to 0.70 mass %, with the balance being Al and inevitable impurities. The aluminum alloy has a ratio (Mn/Si) of the Mn content to the Si content being 2.6 to 4.0. Strength change (tensile strength (A) of the aluminum alloy after heating test−tensile strength (B) of the aluminum alloy before heating test) thereof in a heating test at 600° C.±10° C. for 3 minutes is −5 MPa or more. The present invention can provide an aluminum alloy extruded multi-hole tube for a heat exchanger having excellent extrudability and high strength after brazing, and a method for manufacturing the same.

5 Claims, 1 Drawing Sheet

(56) References Cited

FOREIGN PATENT DOCUMENTS

| | | | | | |
|---|---|---|---|---|---|
| JP | 2006-316294 | A | | 11/2006 | |
| JP | 2007-031730 | A | | 2/2007 | |
| JP | 2008-121108 | A | | 5/2008 | |
| JP | 2009249727 | A | * | 10/2009 | ..... F28F 21/089 |
| JP | 2019-167581 | A | | 10/2019 | |
| WO | 2009/149542 | A1 | | 12/2009 | |
| WO | 2011/148781 | A1 | | 12/2011 | |

OTHER PUBLICATIONS

International Search Report dated Aug. 24, 2021, issued in counterpart Application No. PCT/JP2021/020946, with English translation. (6 pages).
Written Opinion dated Aug. 24, 2021, issued in counterpart Application No. PCT/JP2021/020946. (3 pages).
Extended (Supplementary) European Search Report dated Mar. 18, 2024, issued in counterpart EP Application No. 21823122.3. (22 pages).

* cited by examiner

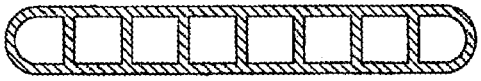

ALUMINUM ALLOY EXTRUDED MULTI-HOLE TUBE FOR HEAT EXCHANGER AND METHOD FOR MANUFACTURING THE SAME

TECHNICAL FIELD

The present invention relates to an aluminum alloy extruded multi-hole tube for a heat exchanger and a method for manufacturing the same.

BACKGROUND ART

In automotive aluminum alloy heat exchangers, such as evaporators and condensers, aluminum alloy extruded multi-hole tubes with a plurality of hollow sections divided by a plurality of partitions are used as fluid passage materials. In recent years, the weight of heat exchangers installed in automobiles has been reduced to reduce the weight of automobiles, and there is a demand for further reduction of the thickness of aluminum alloy materials for heat exchangers.

Increase in strength of the material is required to thin the material. Furthermore, since automotive heat exchangers are brazed to join members, the heat exchangers are required to have high strength after brazing as well as the strength of the material.

On the other hand, the extrusion ratio (sectional area of an extrusion container/sectional area of an extruded material) of aluminum alloy extruded multi-hole tubes reaches several hundreds to several thousands. For this reason, simply increasing the strength of aluminum alloy extruded multi-hole tubes will increase the pressure during extrusion excessively and increase the difficulty of material manufacturing, resulting in a significant decrease in productivity. Therefore, there is a need for a material with not only strength after brazing but also improved extrudability at the same time.

To obtain high-strength aluminum alloy materials, addition of alloying elements, such as Si, Fe, Cu, Mn, and Mg, is generally effective. However, Mg is not recommended to be added actively because fluoride flux reacts with Mg in the material to reduce the activity of the flux and thus reduce the brazability when brazing is executed in an inert gas atmosphere using fluoride flux, which is currently the mainstream brazing method in assembly of aluminum alloy heat exchangers. In addition, Mg increases the pressure during extrusion, and has an aspect of significant reduction in manufacturability. Regarding Cu, there is a risk that Cu included in the material may increase susceptibility to boundary corrosion, depending on the operating environment of the heat exchanger.

For the above reasons, attempts have been made to increase strength in extruded multi-hole tubes by adding Si, Fe, and Mn. For example, Patent Literature 1 discloses a method for improving the strength as extruded tubes by simultaneously adding Mn and Si. However, the disclosed method only covers adjustment of ingredients, and the specific manufacturing method is insufficiently described. In addition, Patent Literature 2 discloses a method for controlling the solid solution and precipitation state of Mn added by homogenization treatment. On the other hand, Patent Literature 2 has no description of the problem of productivity, which is of concern in manufacturing of the extruded tubes.

CITATION LIST

Patent Literature

[Patent Literature 1] Japanese Patent Publication 2006-316294-A

[Patent Literature 2] Japanese Patent Publication 2008-121108-A

SUMMARY OF INVENTION

Technical Problem

Among the above additional elements, Mn and Si are elements that can easily achieve high strength, but if these elements are added in high concentrations by general methods, the solid solution of Mn and Si in the aluminum matrix phase increases deformation resistance in hot work, resulting in extremely poor extrudability.

To deal with this problem, there have been attempts to reduce deformation resistance by decreasing the amount of a solid solution of solute elements in the matrix phase through high-temperature homogenization and low-temperature homogenization treatments, but extrudability is not yet sufficiently ensured.

Although Fe has a certain effect on strength improvement, active addition thereof is not desirable because it tends to form coarse AlFeMn compounds during casting, which may cause premature wear of extrusion tools.

As described above, to produce high-strength extruded multi-hole tubes, it is required to further improve extrudability while increasing strength by addition of Mn and Si.

Therefore, an object of the present invention is to provide an aluminum alloy extruded multi-hole tube for a heat exchanger having excellent extrudability and high strength after brazing, and a method for manufacturing the same.

Solution to Problem

As a result of study to further improve extrudability in extruded multi-hole tubes provided with Mn and Si as additives, the inventors have found that the amount of a solid solution before extrusion can be reduced to improve extrudability by specifying the content ranges of Mn and Si and the content ratio of the elements and by precipitating fine AlMnSi compounds by appropriate homogenization treatment. Furthermore, the inventors have found that the strength after brazing can be improved by forming a solid solution of the AlMnSi compounds again during brazing heating, and have made the present invention.

Specifically, the present invention (1) provides an aluminum alloy extruded multi-hole tube for a heat exchanger, the tube being formed of an aluminum alloy comprising Mn of 0.60 to 1.80 mass % and Si of 0.20 to 0.70 mass %, with the balance being Al and inevitable impurities, the aluminum alloy having a ratio (Mn/Si) of the Mn content to the Si content being 2.6 to 4.0, wherein strength change (tensile strength (A) of the aluminum alloy after heating test−tensile strength (B) of the aluminum alloy before heating test) in a heating test at 600° C.±10° C. for 3 minutes is −5 MPa or more.

In addition, the present invention (2) provides the aluminum alloy extruded multi-hole tube for a heat exchanger of (1), further comprising one or two kinds selected from Ti of 0.10 mass % or less (including 0.00 mass %) and Cu of 0.05 mass % or less (including 0.00 mass %).

In addition, the present invention (3) provides the aluminum alloy extruded multi-hole tube for a heat exchanger of (1) or (2), wherein the strength change in the heating test is −5 to +10 MPa.

In addition, the present invention (4) provides a method for manufacturing an aluminum alloy extruded multi-hole tube for a heat exchanger, the method comprising: two-step homogenization treatment of executing first homogenization treatment of heating an ingot at a heating temperature of 550 to 650° C. for 2 hours or more, followed by second homogenization treatment of heating the ingot at a heating temperature of 450 to 540° C. for 3 hours or more, to set electrical conductivity change (electrical conductivity (C) of the ingot after the second homogenization treatment−electrical conductivity (D) of the ingot before the first homogenization treatment) before and after the two-step homogenization treatment to 20% IACS or more, the ingot being formed of an aluminum alloy comprising Mn of 0.60 to 1.80 mass % and Si of 0.20 to 0.70 mass %, with the balance being Al and inevitable impurities, the aluminum alloy having a ratio (Mn/Si) of the Mn content to the Si content being 2.6 to 4.0; and a hot extrusion step of executing hot extrusion of the treated material of the two-step homogenization treatment at a heating temperature at which an absolute value of a difference (heating temperature during hot extrusion−heating temperature of the second homogenization treatment) between the heating temperature during hot extrusion and the heating temperature of the second homogenization treatment is 50° C. or less.

In addition, the present invention (5) provides the method for manufacturing an aluminum alloy extruded multi-hole tube for a heat exchanger of (4), wherein the aluminum alloy of the ingot further comprises one or two kinds selected from Ti of 0.10 mass % or less (including 0.00 mass %) and Cu of 0.05 mass % or less (including 0.00 mass %).

In addition, the present invention (6) provides the method for manufacturing an aluminum alloy extruded multi-hole tube for a heat exchanger of (4) or (5), wherein, in the two-step homogenization treatment, after the first homogenization treatment is performed, the temperature is continuously lowered to the heating temperature of the second homogenization treatment at an average temperature decrease rate of 20 to 60° C./h, and the second homogenization treatment is continuously performed.

In addition, the present invention (7) provides the method for manufacturing an aluminum alloy extruded multi-hole tube for a heat exchanger of (4) or (5), wherein, in the two-step homogenization treatment, after the first homogenization treatment is performed, the temperature is once lowered to room temperature, and thereafter increased to the heating temperature of the second homogenization treatment at an average temperature increase rate of 20 to 60° C./h, and the second homogenization treatment is continuously performed.

Advantageous Effect of Invention

The present invention can provide an aluminum alloy extruded multi-hole tube for a heat exchanger having excellent extrudability and high strength after brazing, and a method for manufacturing the same.

BRIEF DESCRIPTION OF DRAWING

FIG. 1 is a schematic sectional view of an aluminum alloy extruded multi-hole tube manufactured in Examples and Comparative Examples.

DESCRIPTION OF EMBODIMENTS

The aluminum alloy extruded multi-hole tube for a heat exchanger according to the present invention is an aluminum alloy extruded multi-hole tube for a heat exchanger, formed of an aluminum alloy comprising Mn of 0.60 to 1.80 mass % and Si of 0.20 to 0.70 mass %, with the balance being Al and inevitable impurities, the aluminum alloy having a ratio (Mn/Si) of the Mn content to the Si content being 2.6 to 4.0, wherein strength change (tensile strength (A) of the aluminum alloy after heating test−tensile strength (B) of the aluminum alloy before heating test) in a heating test at 600° C.±10° C. for 3 minutes is −5 MPa or more.

The aluminum alloy extruded multi-hole tube for a heat exchanger according to the present invention is formed of an aluminum alloy comprising Mn of 0.60 to 1.80 mass % and Si of 0.20 to 0.70 mass %, with the balance being Al and inevitable impurities, and the aluminum alloy has a ratio (Mn/Si) of the Mn content to the Si content being 2.6 to 4.0. In other words, the aluminum alloy extruded multi-hole tube for a heat exchanger according to the present invention is an extrusion of an aluminum alloy comprising Mn of 0.60 to 1.80 mass % and Si of 0.20 to 0.70 mass %, with the balance being Al and inevitable impurities, and having a ratio (Mn/Si) of the Mn content to the Si content being 2.6 to 4.0.

The aluminum alloy for the aluminum alloy extruded multi-hole tube for a heat exchanger according to the present invention comprises Mn. Mn is dissolved in the matrix phase as a solid solution in brazing heating to increase strength. The Mn content in the aluminum alloy is 0.60 to 1.80 mass %, and preferably 1.00 to 1.80 mass %. The Mn content in the aluminum alloy falling within the above range provides excellent extrudability and high strength after brazing heating. On the other hand, when the Mn content in the aluminum alloy is less than the above range, the required strength for a heat exchanger tube cannot be achieved. When the Mn content exceeds the above range, a decrease in extrudability is exhibited more noticeably than the strength improvement effect.

The aluminum alloy for the aluminum alloy extruded multi-hole tube for a heat exchanger according to the present invention comprises Si. Si is dissolved in the matrix phase as a solid solution in brazing heating to increase strength. The Si content in the aluminum alloy is 0.20 to 0.70 mass %, and preferably 0.30 to 0.70 mass %. The Si content in the aluminum alloy falling within the above range provides excellent extrudability and high strength after brazing heating. On the other hand, when the Si content in the aluminum alloy is less than the above range, the required strength for a heat exchanger tube cannot be achieved. When the Si content exceeds the above range, a decrease in extrudability is exhibited more noticeably than the strength improvement effect.

The ratio (Mn/Si) of the Mn content to the Si content in the aluminum alloy for the aluminum alloy extruded multi-hole tube for a heat exchanger according to the present invention is 2.6 to 4.0, and preferably 2.6 to 3.5. The aluminum alloy has excellent extrudability by setting the ratio (Mn/Si) of the Mn content to the Si content in the above range and applying two-step homogenization treatment described below, in addition to specifying the contents of Mn and Si in the aluminum alloy in the above ranges. On the other hand, when the Mn/Si ratio in the aluminum alloy is less than the above range, the desired strength may not be obtained as a heat exchanger. When the Mn/Si ratio exceeds the above range, there is a risk that the extrusion limit speed, an index of productivity, may decrease due to insufficient precipitation of fine AlMnSi precipitates.

The aluminum alloy for the aluminum alloy extruded multi-hole tube for a heat exchanger according to the present invention can comprise Ti. Ti is added to the aluminum alloy to further improve corrosion resistance and to properly control the structure during casting. The Ti content in the aluminum alloy is 0.10 mass % or less, and preferably more than 0% and 0.06 mass % or less. In the aluminum alloy, Ti forms regions of a high concentration and regions of a low concentration, and these regions are alternately distributed in layers in the direction of the material's thickness. Because the regions with the low Ti concentration corrode preferentially over the regions with the high Ti concentration, the regions corrode in a layered manner. This structure prevents progress of corrosion in the thickness direction, and improves pitting corrosion resistance and boundary corrosion resistance. When the Ti content of the aluminum alloy exceeds the above range, there is a risk that coarse compounds may be formed during casting, impairing extrudability.

The aluminum alloy for the aluminum alloy extruded multi-hole tube for a heat exchanger according to the present invention can comprise Cu. Cu has the effect of increasing strength by forming a solid solution by heat input during brazing. The Cu content in the aluminum alloy is 0.05 mass % or less. When the Cu content of the aluminum alloy exceeds the above range, boundary corrosion tends to occur and corrosion resistance decreases when the alloy is used in the corrosive environment expected for automotive heat exchangers.

The aluminum alloy for the aluminum alloy extruded multi-hole tube for a heat exchanger according to the present invention may comprise B of 0.10 mass % or less, and impurities, such as Cr, Zn, and Zr, are acceptable in the total amount of 0.25 mass % or less, to the extent that the effect of the present invention is not impaired.

The aluminum alloy extruded multi-hole tube according to the present invention has a strength change (tensile strength (A) of the aluminum alloy after heating test−tensile strength (B) of the aluminum alloy before heating test) in a heating test at 600° C.±10° C. for 3 minutes of −5 MPa or more, preferably −5 to +10 MPa, and particularly preferably −5 to +5 MPa. With the strength change of the aluminum alloy extruded multi-hole tube in the above heating test within the above range, the strength of the tube after brazing heating increases, or is prevented from decreasing excessively due to brazing heating. The strength change in the above heating test is obtained by first measuring the tensile strength (A) of the tube before the heating test, then heating the tube at 600° C.±10° C. for 3 minutes, then measuring the tensile strength (B) of the tube after the heating test, and then calculating the strength change during the heating test from the obtained test results using the formula "tensile strength (A) of the aluminum alloy after the heating test−the tensile strength (B) of the aluminum alloy before the heating test". A strength change of −5 MPa or more in the heating test means that the value of "tensile strength (A) of the aluminum alloy after heating test−tensile strength (B) of the aluminum alloy before heating test" is −5 MPa or more. This means that one of the following (i) to (iii) is satisfied: (i) tensile strength (A) and tensile strength (B) are the same; (ii) tensile strength (A) is greater than tensile strength (B); and (iii) tensile strength (A) is less than tensile strength (B), but the absolute value of the difference between them is within 5 MPa, that is, (i) (A)−(B)=0 MPa, (ii) (A)−(B)>0 MPa, and (iii) −5 MPa<(A)−(B)<0 MPa.

The aluminum alloy extruded multi-hole tube according to the present invention has the Mn content, the Si content, and their content ratio (Mn/Si) falling within the ranges specified in the present invention, and the solid solution states of Mn and Si and the precipitation state of the AlMnSi precipitates allowing the strength change in the heating test at 600° C.±10° C. for 3 minutes to fall within the range specified in the present invention. With this structure, the aluminum alloy has high workability during hot extrusion, and the strength thereof does not decrease, or decreases within a small range, due to brazing heating.

The aluminum alloy extruded multi-hole tube according to the present invention is suitably manufactured by the method for manufacturing an aluminum alloy extruded multi-hole tube according to the present invention as described below.

The method for manufacturing an aluminum alloy extruded multi-hole tube is a method for manufacturing an aluminum alloy extruded multi-hole tube for a heat exchanger, the method comprising: two-step homogenization treatment of executing first homogenization treatment of heating an ingot at a heating temperature of 550 to 650° C. for 2 hours or more, followed by second homogenization treatment of heating the ingot at a heating temperature of 450 to 540° C. for 3 hours or more, to set electrical conductivity change (electrical conductivity (C) of the ingot after the second homogenization treatment−electrical conductivity (D) of the ingot before the first homogenization treatment) before and after the two-step homogenization treatment to 20% IACS or more, the ingot being formed of an aluminum alloy comprising Mn of 0.60 to 1.80 mass % and Si of 0.20 to 0.70 mass %, with the balance being Al and inevitable impurities, the aluminum alloy having a ratio (Mn/Si) of the Mn content to the Si content being 2.6 to 4.0; and a hot extrusion step of executing hot extrusion of the treated material of the two-step homogenization treatment at a heating temperature at which an absolute value of a difference (heating temperature during hot extrusion−heating temperature of the second homogenization treatment) between the heating temperature during hot extrusion and the heating temperature of the second homogenization treatment is 50° C. or less.

The method for manufacturing an aluminum alloy extruded multi-hole tube according to the present invention comprises, at least, a casting step, homogenization treatment, and a hot extrusion step.

The casting step for the method for manufacturing an aluminum alloy extruded multi-hole tube according to the present invention is a step of casting an aluminum alloy of the composition described above by a common method, such as melting and semi-continuous casting, to obtain billets for extrusion.

The ingot is formed of an aluminum alloy comprising Mn of 0.60 to 1.80 mass %, and preferably 1.00 to 1.80 mass %, Si of 0.20 to 0.70 mass %, and preferably 0.30 to 0.70 mass %, a Ti content of 0.10 mass % or less, and preferably more than 0% and 0.06 mass % or less, and a Cu content of 0.05 mass % or less, with the balance being Al and inevitable impurities, and the ratio (Mn/Si) of the Mn content to the Si content is 2.6 to 4.0, and preferably 2.6 to 3.5.

The two-step homogenization treatment for the method for manufacturing an aluminum alloy extruded multi-hole tube is two-step homogenization treatment in which the ingot (billet for extrusion) obtained by the casting step is first subjected to first homogenization treatment, followed by second homogenization treatment.

In the first homogenization treatment, the ingot obtained by the casting step is heated at a heating temperature of 550 to 650° C. for 2 hours or more. In the second homogenization treatment, the treated material having been subjected to the first homogenization treatment is heated at a heating temperature of 450 to 540° C. for 3 hours or more. In the two-step homogenization treatment, the electrical conductivity change (electrical conductivity (C) of the ingot after the second homogenization treatment−electrical conductivity (D) of the ingot before the first homogenization process) of the ingot before and after the two-step homogenization process is set to 20%. IACS or more by conducting the first homogenization treatment and the second homogenization treatment.

In the first homogenization treatment, coarse crystallized products formed during casting solidification are decomposed, granulated, or redissolved as a solid solution. The heating temperature in the first homogenization treatment is 550 to 650° C., and preferably 580 to 620° C. The heating temperature in the first homogenization treatment is within the above range so that the coarse crystallized material formed during casting solidification can be decomposed, granulated, or redissolved as a solid solution. On the other hand, when the heating temperature of the first homogenization treatment is less than the above range, the effect is not sufficient. Although the effect increases as the heating temperature becomes higher, when the temperature exceeds the above range, the temperature may exceed the solidus temperature and the billet may partially melt. The heating time in the first homogenization treatment is 2 hours or more, and the treatment time is preferably 10 hours or more because the reaction proceeds more with a longer heating time. However, when the heating time of the first homogenization treatment exceeds 24 hours, the effect is saturated. When the treatment time exceeds 24 hours, no further effect can be expected, which is undesirable from an economic standpoint. The heating time in the first homogenization treatment is more preferably 10 to 24 hours.

In the first homogenization treatment, coarse crystallized products formed during casting solidification is decomposed, granulated or redissolved as a solid solution. The first homogenization treatment also promotes the solid solution of the solute elements, Mn and Si, in the matrix phase at the same time. When the solid solubility of the solute elements in the matrix phase is high, the movement velocity of dislocations in the matrix phase decreases and the deformation resistance increases. Therefore, when only the first homogenization treatment is performed as the homogenization treatment and the resulting treated material is hot extruded, the extrudability decreases.

Therefore, performing the second homogenization treatment after the first homogenization treatment allows Mn and Si in a solid solution in the matrix phase to precipitate and reduces the solid solubility of Mn and Si, thus lowering deformation resistance and improving extrudability in the subsequent hot extrusion process. The heating temperature in the second homogenization treatment is 450 to 540° C., and preferably 480 to 520° C. The heating temperature in the second homogenization treatment in the above range allows Mn and Si in a solid solution in the matrix phase to precipitate and reduces the solid solubility of Mn and Si, thus lowering deformation resistance and improving extrudability in the subsequent hot extrusion process. On the other hand, when the heating temperature of the second homogenization treatment is less than the above range, the effect is not sufficient. When the heating temperature exceeds the above range, precipitation is difficult to occur and the effect is insufficient. The heating time in the second homogenization treatment is 3 hours or more, and the treatment time is preferably 5 hours or more because the reaction proceeds more with a longer heating time. However, when the heating time of the second homogenization treatment exceeds 24 hours, the effect is saturated. When the treatment time exceeds 24 hours, no further effect can be expected, which is undesirable from an economic standpoint. The heating time in the second homogenization treatment is more preferably 5 to 15 hours.

In the method for manufacturing an aluminum alloy extruded multi-hole tube, the ingot (billet) is subjected to the first homogenization treatment and subsequently the second homogenization treatment to reduce the solid solubility of solute elements in the matrix phase, thereby improving extrudability. The electrical conductivity of the ingot serves as an index of the solid solubility of the solute element. As the solid solubility increases, the electrical conductivity decreases. As precipitation progresses and the solid solubility decreases, the conductivity increases. To obtain good extrudability, the solid solubility should be lowered before extrusion. Specifically, the electrical conductivity change before and after the two-step homogenization treatment should be 20% IACS or more, and preferably 25% IACS or more. This structure enables certain improvement of extrudability. Furthermore, lowering the electrical conductivity of the ingot prior to extrusion also contributes to suppressing decrease in strength after brazing, as described below. When the electrical conductivity change of the ingot before and after the two-step homogenization treatment is less than the above range, the solid solubility before extrusion is high, resulting in high deformation resistance in hot work, and the strength after brazing is reduced due to progress of precipitation of added elements during brazing. The greater the difference in electrical conductivity of the ingot before and after the two-step homogenization treatment, the more desirable it is. The upper limit thereof is, for example, 35% IACS. In the present invention, the electrical conductivity change of the ingot before and after the two-step homogenization treatment is the value obtained by the calculation "electrical conductivity (C) of the ingot after the second homogenization treatment−electrical conductivity (D) of the ingot before the first homogenization treatment".

In the two-step homogenization treatment, after the first homogenization treatment is performed at the heating temperature of the first homogenization treatment, the temperature is continuously lowered to the heating temperature of the second homogenization treatment at an average temperature decrease rate of 20 to 60° C./h. In this manner, the second homogenization treatment can be performed continuously at the heating temperature of the second homogenization treatment.

As another example, in the two-step homogenization treatment, after the first homogenization treatment is performed at the heating temperature of the first homogenization treatment, the temperature is once lowered to room temperature, e.g., 200° C. or less, and then increased to the heating temperature of the second homogenization treatment at an average temperature increase rate of 20 to 60° C./h. In this manner, the second homogenization treatment can be performed continuously at the heating temperature of the second homogenization treatment.

In the two-step homogenization treatment, the electrical conductivity change of the ingot before and after the two-step homogenization treatment can be set to 20% IACS or more, and preferably 25% IACS or more, by performing the first homogenization treatment and the second homogenization treatment described above.

The hot extrusion step for the method for manufacturing an aluminum alloy extruded multi-hole tube for a heat exchanger according to the present invention is a step of hot extruding the treated material of the two-step homogenization treatment to obtain an extruded multi-hole tube. In the hot extrusion step, the heating temperature during hot extrusion is a temperature at which the absolute value of the difference (heating temperature during hot extrusion−heating temperature of the second homogenization treatment) between the heating temperature during hot extrusion and the heating temperature of the second homogenization treatment is 50° C. or less, and preferably 30° C. or less. In other words, the heating temperature during hot extrusion in the hot extrusion step is within ±50° C., and preferably ±30° C., of the heating temperature of the second homogenization treatment. In hot extrusion, the billet heating temperature before extrusion is set to a temperature at which the absolute value of the difference (heating temperature during hot extrusion−heating temperature during second homogenization treatment) between the billet heating temperature during hot extrusion and the second homogenization treatment temperature is 50° C. or less, and preferably 30° C. or less, to suppress redissolution of solute elements as a solid solution during hot extrusion. In other words, in the hot extrusion step for the method for manufacturing an aluminum alloy extruded multi-hole tube for a heat exchanger according to the present invention, the added Mn and Si can be retained in the form of fine AlMnSi precipitates precipitated in the second homogenization treatment. The aluminum alloy extruded multi-hole tube obtained by hot extrusion is then mounted on a heat exchanger by brazing, and subjected to brazing joint. During the brazing process, the aforementioned fine AlMnSi precipitates are redissolved in the matrix phase as a solid solution, and high strength can be retained after brazing. On the other hand, when hot extrusion is performed at a heating temperature at which the absolute value of the difference between the heating temperature during hot extrusion and the heating temperature of the second homogenization treatment exceeds the above range and the extrusion temperature is higher, the AlMnSi precipitates are redissolved as a solid solution before or during extrusion, resulting in reduction of extrudability. When the extrusion temperature is lower, the extrudability is reduced due to increase of hot deformation resistance.

In the method for manufacturing an aluminum alloy extruded multi-hole tube for a heat exchanger according to the present invention, after the hot extrusion step, coating, zinc spraying to improve corrosion resistance, or the like may be performed, if necessary.

Thus, in the method for manufacturing an aluminum alloy extruded multi-hole tube for a heat exchanger according to the present invention, extrudability in hot extrusion is increased by setting the Mn content, the Si content, and their content ratio (Mn/Si) in the ingot to the ranges specified in the present invention, and executing the two-step homogenization treatment for the method for manufacturing an aluminum alloy extruded multi-hole tube for a heat exchanger. Furthermore, by setting the Mn content, the Si content, and their content ratio (Mn/Si) in the ingot to the ranges specified in the present invention, and executing the hot extrusion for the method for manufacturing an aluminum alloy extruded multi-hole tube for a heat exchanger, the strength of the obtained aluminum alloy extruded multi-hole tube for a heat exchanger does not decrease, or decreases within a small range even when the strength decreases, due to brazing heating.

The aluminum alloy extruded multi-hole tube for a heat exchanger according to the present invention is an aluminum alloy extruded multi-hole tube for a heat exchanger obtained by the above method for manufacturing an aluminum alloy extruded multi-hole tubes for a heat exchanger according to the present invention. That is, the aluminum alloy extruded multi-hole tube for a heat exchanger according to the present invention is an aluminum alloy extruded multi-hole tube for a heat exchanger obtained by performing the two-step homogenization treatment and the hot extrusion step according to the above method for manufacturing an aluminum alloy extruded multi-hole tube for a heat exchanger according to the present invention.

The aluminum alloy extruded multi-hole tube for a heat exchanger according to the present invention and the aluminum alloy extruded multi-hole tube for a heat exchanger obtained by the method for manufacturing an aluminum alloy extruded multi-hole tube for a heat exchanger according to the present invention are mounted together with members, such as a header and a fin, and subjected to brazing heating at, for example, 590 to 610° C., and preferably 595 to 605° C., for example, for 1 to 5 minutes, and preferably 2 to 4 minutes, in an inert gas atmosphere, such as nitrogen gas, to manufacture a heat exchanger.

Examples are given below to specifically illustrate the present invention, but the present invention is not limited to the examples described below.

EXAMPLES

Aluminum alloys having the compositions listed in Table 1 were casted into billets for extrusion, the resulting billets were subjected to first homogenization treatment at 600° C. for 10 hours, followed by second homogenization treatment at 500° C. for 10 hours, and then hot extruded at 500° C. to the sectional shape illustrated in FIG. 1 to obtain extruded flat multi-hole tubes. FIG. 1 is a schematic diagram, and the specific dimensions of the extruded flat multi-hole tubes were 14.0 mm in width, 2.5 mm in height, 0.4 mm in outer wall thickness, 0.4 mm in inner column wall thickness, and 19 holes.

The electrical conductivities of the billets before and after the first and second homogenization treatments, the limit extrusion speeds for hot extrusion of the billets into tubes, and the strength changes before and after the heating test of the extruded flat multi-hole tubes were evaluated by the following methods.

<Electrical Conductivity>

The electrical conductivities of the billets were measured before the first homogenization treatment and after the second homogenization treatment by a sigma tester. The electrical conductivity before the first homogenization treatment was compared with the electrical conductivity after the second homogenization treatment, and the billets with a difference of 25% or more between the two were evaluated as ◎, those with a difference of 20% or more and less than 25% as ○, and those with a difference of less than 20% as x.

<Limit Extrusion Speed>

The limit extrusion speed (m/min) of a conventional alloy in which only Mn was added to pure aluminum was used as the standard, and the limit extrusion speed of each of the billets was evaluated as a ratio to this (the limit extrusion speed of the conventional alloy was set to 1.0). The billets with a limit extrusion speed of 0.9 to 1.0 were evaluated as ◎, those with a limit extrusion speed of 0.8 or more and less than 0.9 as ○, those with a limit extrusion speed of 0.7 or more and less than 0.8 as Δ, and those with a limit extrusion speed less than 0.7 as x.

<Heating Test>

The test materials were subjected to a heating test at 600±10° C. for 3 minutes, and tensile test pieces were collected and subjected to a tensile test. A tensile test was also conducted before the heating test in the same manner, and the change in tensile strength before and after the heating test was evaluated. The test materials with a tensile strength change before and after the heating test of 0 MPa or more and with no decrease in strength, and with a decrease in strength but with a strength change of −5 MPa or more and less than 0 MPa were evaluated as ○, and those with a decrease in strength by the heating test and with a strength change of less than −5 MPa (the absolute value of strength change was more than 5 MPa) as x.

(Evaluation Results)

Table 2 lists the results. All of Examples 1 to 4 listed in Table 2 passed all the tests, with an electrical conductivity change of 20% or more before and after the two-step homogenization treatment, the extrusion limit speed equivalent to that of the conventional alloy or with a value that did not impair productivity, and a strength change of 5 MPa or more in the heating test.

On the other hand, Comparative Example 1 was rejected because the extrusion limit speed was lower than that of the conventional alloy due to a Mn/Si ratio more than 4.0, although the change in electrical conductivity before and after the two-step homogenization treatment was 20% or more and the strength change in the heating test was −5 MPa or more.

TABLE 1

| | Si (mass %) | Mn (mass %) | Mn/Si (mass ratio) |
|---|---|---|---|
| Example 1 | 0.40 | 1.20 | 3.0 |
| Example 2 | 0.50 | 1.40 | 2.8 |
| Example 3 | 0.60 | 1.60 | 2.7 |
| Example 4 | 0.70 | 1.80 | 2.6 |
| Comparative Example 1 | 0.40 | 1.80 | 4.5 |

balance being Al and inevitable impurities, the aluminum alloy having a ratio (Mn/Si) of Mn content to Si content being 2.6 to 3.0, wherein strength change (tensile strength (A) of the aluminum alloy after heating test−tensile strength (B) of the aluminum alloy before heating test) in a heating test at 600° C.±10° C. for 3 minutes is −5 MPa or more.

2. The aluminum alloy extruded multi-hole tube for a heat exchanger according to claim 1, wherein the strength change in the heating test is −5 to +10 MPa.

3. A method for manufacturing an aluminum alloy extruded multi-hole tube for a heat exchanger, the method comprising:

two-step homogenization treatment of executing first homogenization treatment of heating an ingot at a heating temperature of 550 to 650° C. for 2 hours or more, followed by second homogenization treatment of heating the ingot at a heating temperature of 450 to 540° C. for 3 hours or more, to set electrical conductivity change (electrical conductivity (C) of the ingot after the second homogenization treatment−electrical conductivity (D) of the ingot before the first homogenization treatment) before and after the two-step homogenization treatment to 20% IACS or more, the ingot being formed of an aluminum consisting of Mn of 1.20 to 1.80 mass % and Si of 0.40 to 0.70 mass %, optionally one or more selected from Ti of 0.10 mass % or less, and Cu of 0.05 mass % or less, with the balance being Al and inevitable impurities, the aluminum alloy having a ratio (Mn/Si) of Mn content to Si content being 2.6 to 3.0, and a hot extrusion step of executing hot extrusion of the treated material of the two-step homogenization treatment at a heating temperature at which an absolute value of a difference (heating temperature during hot extrusion−heating temperature of the second homogenization treatment) between the heating temperature during hot extrusion and the heating temperature of the second homogenization treatment is 50° C. or less.

4. The method for manufacturing an aluminum alloy extruded multi-hole tube for a heat exchanger according to claim 3, wherein, in the two-step homogenization treatment, after the first homogenization treatment is performed, the temperature is continuously lowered to the heating temperature of the second homogenization treatment at an average temperature decrease rate of 20 to 60° C./h, and the second homogenization treatment is continuously performed.

5. The method for manufacturing an aluminum alloy extruded multi-hole tube for a heat exchanger according to claim 3, wherein, in the two-step homogenization treatment,

TABLE 2

| | Si mass % | Mn mass % | Mn/Si | Electrical conductivity: Before homogenization % IACS | Electrical conductivity: After homogenization % IACS | Electrical conductivity: Change % IACS | Evaluation | Extrusion limit speed: Relative value | Extrusion limit speed: Evaluation | Strength: Before brazing MPa | Strength: After brazing MPa | Strength: Change MPa | Evaluation |
|---|---|---|---|---|---|---|---|---|---|---|---|---|---|
| Example 1 | 0.40 | 1.20 | 3.00 | 27 | 54 | 27 | ◎ | 0.91 | ◎ | 100 | 104 | 4 | ○ |
| Example 2 | 0.50 | 1.40 | 2.80 | 25 | 53 | 28 | ◎ | 0.91 | ◎ | 106 | 110 | 4 | ○ |
| Example 3 | 0.60 | 1.60 | 2.67 | 24 | 53 | 29 | ◎ | 0.82 | ○ | 113 | 116 | 3 | ○ |
| Example 4 | 0.70 | 1.80 | 2.57 | 23 | 53 | 30 | ◎ | 0.73 | Δ | 123 | 123 | 0 | ○ |
| Comparative Example 1 | 0.40 | 1.80 | 4.50 | 22 | 46 | 24 | ○ | 0.64 | X | 107 | 108 | 1 | ○ |

The invention claimed is:

1. An aluminum alloy extruded multi-hole tube for a heat exchanger, the tube being formed of an aluminum alloy consisting of Mn of 1.20 to 1.80 mass % and Si of 0.40 to 0.70 mass %, optionally one or more selected from Ti of 0.10 mass % or less, and Cu of 0.05 mass % or less, with the after the first homogenization treatment is performed, the temperature is once lowered to room temperature, and thereafter increased to the heating temperature of the second homogenization treatment at an average temperature increase rate of 20 to 60° C./h, and the second homogenization treatment is continuously performed.

* * * * *